United States Patent [19]

April et al.

[11] Patent Number: 4,597,830

[45] Date of Patent: Jul. 1, 1986

[54] METHOD AND PULPING COMPOSITION FOR THE SELECTIVE DELIGNIFICATION OF LIGNOCELLULOSIC MATERIALS WITH AN AQUEOUS AMINE-ALCOHOL MIXTURE IN THE PRESENCE OF A CATALYST

[75] Inventors: Gary C. April, Tuscaloosa; Ramkrishna G. Nayak, University, both of Ala.

[73] Assignee: The University of Alabama, University, Ala.

[21] Appl. No.: 505,972

[22] Filed: Jun. 20, 1983

[51] Int. Cl.[4] ..... D21C 3/20

[52] U.S. Cl. ..... 162/32; 162/72; 162/77

[58] Field of Search ..... 162/72, 77, 32, 40; 8/676

[56] References Cited

U.S. PATENT DOCUMENTS

| | | | |
|---|---|---|---|
| 3,585,104 | 6/1971 | Kleinert | 162/77 |
| 3,980,677 | 9/1976 | Hohmann et al. | 8/676 |
| 4,178,861 | 12/1979 | Vanderhock et al. | 162/72 |

OTHER PUBLICATIONS

Green et al., "Alkaline Pulping in Aqueous Alcohols and Amines"; *TAPPI* May 1982, vol. 65, No. 5, p. 133.

*Primary Examiner*—Steve Alvo

*Attorney, Agent, or Firm*—Oblon, Fisher, Spivak, McClelland & Maier

[57] ABSTRACT

A pulping liquor for the delignification of lignocellulosic materials is disclosed which avoids the use of sodium hydroxide and so avoids degradation of substantial portions of the cellulose component, and simultaneously avoids the use of sulphide or other environmental pollutants. The cooking process employing this liquor can advantageously include recycling of the liquor to provide sustained delignification from the same original liquor provided, and distillation of spent liquor to recover the essential components thereof.

The liquor is comprised of alcohol, an amine and water, each present in amount of 1-12 parts by volume. The liquor is further used in the presence of a quinone and/or azine catalyst.

11 Claims, 5 Drawing Figures

METHOD AND PULPING COMPOSITION FOR THE SELECTIVE DELIGNIFICATION OF LIGNOCELLULOSIC MATERIALS WITH AN AQUEOUS AMINE-ALCOHOL MIXTURE IN THE PRESENCE OF A CATALYST

The Government has rights in this invention pursuant to Contract CPE 8015591. awarded by the National Science Foundation.

BACKGROUND OF THE INVENTION

1. Field of the Invention

This invention relates to a method for the delignification and pulping of lignocellulosic materials such as softwoods, hardwoods and derivatives or substrate materials related thereto, and the delignification liquor employed therein.

2. Description of the Prior Art

An economic, safe and nonpolluting process for the delignification of lignocellulosic materials such as wood and wood derivatives has long been sought, as the resultant pulp is widely employed, in both the paper industries and newly developed biomass industries as the raw product therefore. A conventional delignification process, commonly referred to as the "Kraft" process, involves the cooking of chipped lignocellulosic materials in a treatment liquor of sodium hydroxide and sodium sulfide. Such treatments are undesirable in that the pulping process inevitably degrades a significant portion of the desired cellulose component, substantially reducing the pulp yield of the process. Additionally, processes of this type which rely on sulfide components in the treatment liquors present the problem of the disposal of sulfide pollutants, which requires further expensive processing.

In an effort to avoid the loss of cellulose experienced in conventional processes, other treatment liquor components have been employed, such as ethylenediamine or aqueous ethanol, see U.S. Pat. Nos. 2,218,479 and 3,585,104, respectively. However, these components alone, have not been effective in avoiding substantial cellulose degradation. Accordingly, in order to secure sufficiently high yields of pulp, it has been common practice to incorporate in these treatment liquors sulfide components, such as sodium sulfide with ethylenediamine and ammonium sulfide with aqueous alcohols (U.S. Pat. No. 4,329,200). Although these processes give substantially higher pulp yields with correspondingly low lignin content, the problem presented by the presence of sulfide pollutants not only remains, but is aggravated thereby.

In order to minimize the effect of sulfide pollutants, U.S. Pat. No. 4,012,280 proposes delignification of lignocellulosic materials by treatment with an aqueous sodium hydroxide solution in the presence of a cyclic keto compound such as anthraquinone. This process is free of sulfur and is stated to have the advantage of producing no polluting or odor producing sulfur compounds. However, it results in only a very marginal gain in pulp yield, due to substantial degradation of cellulosic material.

While some of the aforementioned delignification processes could provide a viable system to inhibit the degradation of cellulose, it has never been possible to avoid the use of pollutants such as inorganic sulfides. Similarly, while some other processes provided a delignification process alleviating the pollution problems, they failed to inhibit the degradation of the cellulose.

It is therefore an object of the present invention to provide a selective delignification process while at the same time significantly retarding degradation of cellulosic components.

It is another object of this invention to provide a process for the delignification of lignocellulosic materials which avoids the presence of sulfide pollutants.

It is yet a further object of this invention to provide treatment liquors which can be practically recovered and reused in the above-identified processes.

These and other objects may be secured by the invention described below.

SUMMARY OF THE INVENTION

Lignocellulosic materials may be delignified and pulped in a reactor vessel containing a pulping liquor comprised of aliphatic amines and/or polyamines and aqueous lower aliphatic alcohols, further in the presence of anthraquinone and/or one or more of its derivatives, an azine, or their combination. The material to be pulped is cooked in the above liquor for a period of time sufficient to delignify the material, and thereafter the resultant cellulosic pulp is recovered from the reactor, for instance by separating it from the spent liquor and then steam stripping or hot water washing to remove the entrapped solvents. The recovered spent liquor and washings can be recycled back to effect the delignification of a new batch of lignocellulosics until a considerable concentration of lignin is achieved in the spent liquor. The organic solvents can then be recovered by distilling the concentrated spent liquor in the presence of sodium hydroxide and effectively reutilizing the removed material for further delignification application. It is the discovery of the present invention that aliphatic polyamines such as ethylenediamine in combination with aqueous alcohols such as ethanol in the presence of catalyst like anthraquinone provide an effective and efficient pulping agent for the selective removal of lignin while protecting the cellulosic materials from degradation.

DETAILED DESCRIPTION OF THE PREFERRED EMBODIMENTS

Figure 1:
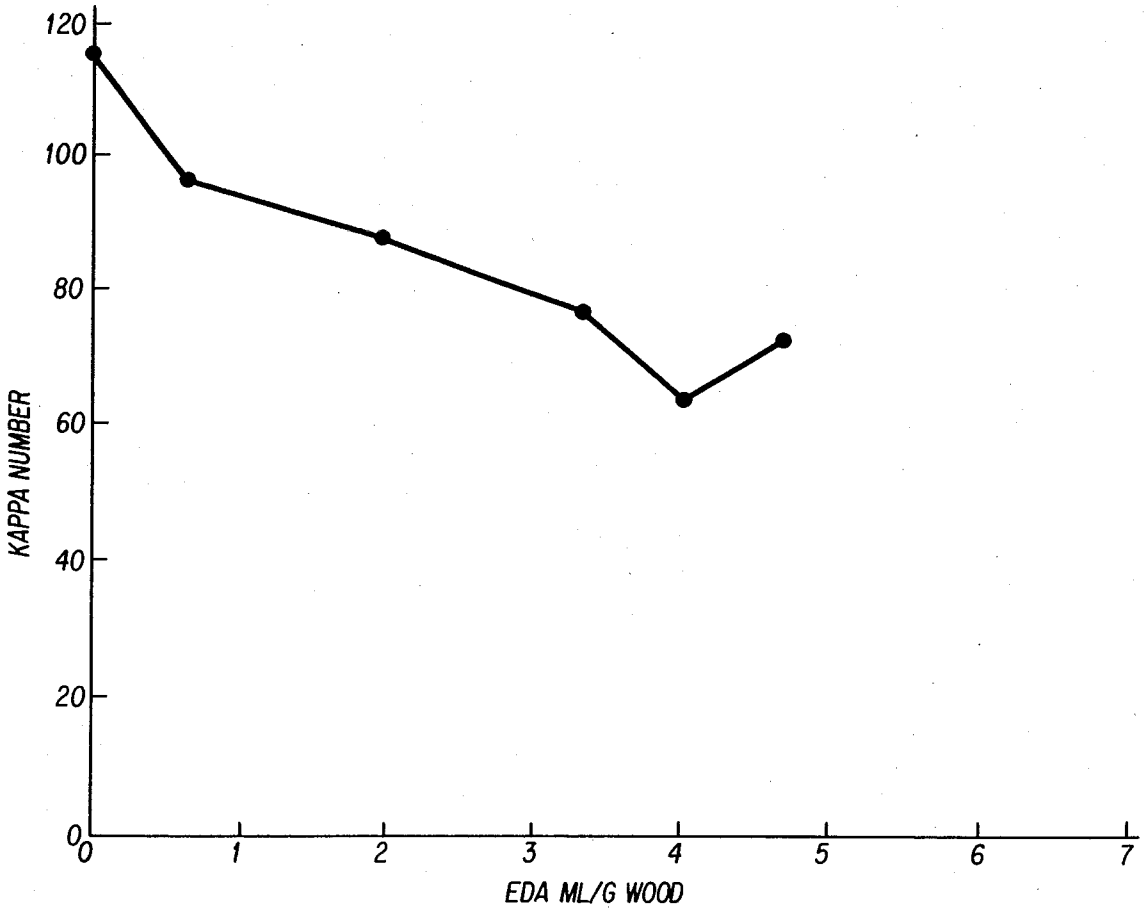
FIG. 1 is a graphic illustration of the effects of varying amounts of ethylenediamine in this invention.

Lignocellulosic materials, such as soft- and hardwoods and their derivatives, may be delignified and otherwise pulped by cooking them in a closed reactor vessel in the organic solvent mixture (hereinafter, pulping liquor) of this invention. Surprisingly high yields of pulp, of up to 13% or more (percentage expressed on original lignocellulosic material) than that derived from the conventional "Kraft" process can be achieved.

By softwood is meant species such as pine, spruce and balsam fir. By hardwood is meant species such as birch, aspen, maple and sweet gum.

The pulping liquor solution employed is comprised of volatile alcohols such as ethanol or methanol, ethylenediamine or related aliphatic polyamines and water. For purposes of clarity, this invention will be further described with reference to the use of ethanol and ethylenediamine. However, as is discussed below, the invention is not so limited. Broadly, the ethanol, ethylenediamine and water should each be present in amounts of 1–12 parts by volume. When treating softwoods, an equally effective but more economical mix may be employed, and the ethanol, ethylenediamine and water should each be present in amounts from 1–5 parts by volume. A particularly preferred composition is comprised of ethanol, ethylenediamine and water in a volume ratio of 1:5:5, respectively. However, for hardwoods the preferred composition for the same components is comprised of ethanol, ethylenediamine and water in a volume ratio of 1:7.5:11.5 respectively. The above-described pulping liquor is cooked with the lignocellulosic material in the ratio of grams lignocellulosic material to milliliters pulping liquor in the range of 1:4 to 1:15. In a particularly preferred process, the ratio of grams of lignocellulosic material to pulping liquor is 1:4–1:12.

This reaction is catalyzed by the presence of anthraquinone, or its derivatives, azines, or both. Although the present invention is demonstrated with anthraquinone, other members of the quinone family are equally effective. Naphthaquinone, methylanthraquinone, amino-anthraquinone are among preferred species. The amount of anthraquinone required can be determined by the amount of lignocellulosic material present, and should generally be 0.1 to 10% of the lignocellulosic material, by weight, preferably in the range of 0.5–1.5%. These ratios and percents are based upon the oven dry weights of the lignocellulosic material. As will occur to one of ordinary skill in the art, the amounts of each component of the reaction mixture are interdependent, and anthraquinone required can be varied by varying the amount of pulping liquor. Accordingly, the anthraquinone catalyst should be present in amounts of grams of catalyst per milliliter of pulping liquor on the order of from 0.001–0.1:4 to 0.001–0.1:15, and preferably 0.005–0.015:4 to 0.005–0.015:12.

The above reaction mixture is cooked in a closed reactor vessel at temperatures from 140° C.–200° C., for from 50–360 minutes. Particularly preferred temperatures and times for softwood range between 170°–190° C., and from 60–120 minutes, respectively. Preferred temperature and times for hardwood range between 160°–175° C. and from 60–100 minutes, respectively.

When equal amounts of identical lignocellulosic materials are cooked in the above process and by the above-described conventional Kraft process, surprisingly, superior yields are secured by the instant process. Thus, the total pulp yield from southern yellow pine according to the instant process is on the order of 57.75% at 28.5 kappa number. The corresponding values for the Kraft process are 45.80 and 36.5 respectively. Similarly, the total pulp yield according to the instant process for sweet gum is on the order of 59.9% at 19.2 kappa number. Corresponding values for the Kraft pulping of sweet gum are 52.0 and 32.8 respectively. It can therefore be seen that the combination of ethylenediamine and aqueous ethanol in the presence of anthraquinone gives dramatically superior protection and preservation of the cellulose pulp component of the lignin-containing material.

Although the inventors do not wish to be bound by this theory, it appears that the ethylenediamine present retards attack on the mannans, while ethanol seems to preserve the xylans.

It will also be observed that the instant process, by totally eliminating inorganics from the pulping liquor and the delignification system, avoids the sulfide pollution problems of the prior art. Moreover, as the solvent mixture of the instant process boils at approximately 115° C., a very high recovery of the solvent mixture is possible by simple distillation, making the process and solvent mixture even more economically superior. Thus almost 99.0% of ethylenediamine charged and 95–97% ethanol charged were recovered by simple distillation in the presence of sodium hydroxide.

An important feature of the spent liquor is its continued delignification potentiality. The spent liquor, after adjusting the concentration of ethylenediamine, ethanol or anthraquinone can be recycled back to delignify more lignocellulosic material. Although gradual deterioration occurs in its capacity to delignify the wood, it is possible to precipitate the lignin from the 2–3 times recycled and concentrated (in lignin) spent liquor, thereupon making it possible to reuse the liquor in the pulping process. In this particular and preferred embodiment, the process is explained using a closed reactor. However, the process is also suitable for a continuous reactor such as a Kamyr digester, when lignocellulosic material and pulping liquor are fed in a countercurrent fashion.

The pulp in unbeaten form produced by treatment of lignocellulosic material with the pulping liquor of the instant process produces a paper with greater tear strength than that produced from unbleached and unbeaten Kraft pulp. The unbeaten Kraft pulp will afford a tear factor of 219±5% while the aqueous ethylenediamine-ethanol-anthraquinone pulp in accordance with the present invention gives a tear factor of 261±5%. Beating the pulp reduces the tear factor in both instances to about the same level of 175±5% at 600 C.S.F. (Canadian Standard Freeness) level.

Further features and characteristics of paper and pulp produced according to the present invention are of value. For example, the operating pressure of the digester is 140 psig and is significantly lower than the typically high operating pressure (approx. 500 psig) for the ethanol or ethanol-ammonium sulfide processes cited above.

Thus, the process is distinct from the commercial Kraft process and the more recent organosolv sulfide methods although borrows some technology from each. Both the components of the reaction mixture in the Kraft process, viz. sodium hydroxide and sodium sulfide, are detrimental to the process. While sodium hydroxide severely degrades the cellulosic components, losing considerable amounts of pulp yield, sodium sulfide poses a serious environmental pollution problem. The instant process avoids sodium hydroxide by using the mixture of ethanol and ethylenediamine. Similarly, anthraquinone replaces sodium sulfide resulting in a novel pollution free, high yield process.

The invention is illustrated by the following examples and its objects, features and advantages will become apparent in these examples and accompanying figures. However, it should be noted that these examples are illustrative only and the scope of the invention is not thereby limited. Despite the fact that the inventions are carried out using a mixture of ethanol-ethylenediamine and in the presence of anthraquinone, the mixture prepared by permutation-combination of the following classes of compounds would also be effective.

Class A—Aliphatic amines and polyamines such as ethylenediamine, propylenediamine, hexamethylenediamine, methylaniline, ethylamine, etc.

Class B—Lower aliphatic alcohols like methanol, ethanol, butanol, pentanol, etc.

Class C—Quinones and azines, such as benzoquinone, anthraquinone, naphthaquinone, phenazine and their derivatives.

In the examples, the kappa number and analysis of ethanol, ethylenediamine, carbohydrate analysis were carried out by the following art-recognized methods.

| | |
|---|---|
| Kappa number | Tappi-T236 OS-76 |
| Ethanol analysis | Gas chromatography method |
| Ethylenediamine | Potentiometric Titration |
| Carbohydrate analysis | Tappi - T249 PM-75 |

In the following examples, pulping was carried out in stainless steel pressure vessels of either one of the following two types: (1) 30 ML capacity shaking bomb reactor in an oil bath and (2) 1.5 liter capacity electrically heated Parr reactor equipped with a stirrer. While charging the shaking bomb reactor, 2.194 grams of air dry southern yellow pine wood meal (equivalent to 2.0 grams of oven dry substance) passing through #10 U.S. mesh and retained on #30 mesh was used. However, 114.9 g of air dry industrial size chips (equivalent to 100.0 g of oven dry wood) were employed in the electrically heated Parr reactor. The oil heated bomb takes one and one-half minutes to reach the pulping temperature and is maintained to within ±0.5° C. of said maximum, while the electrically heated Parr reactor needs 40 minutes to reach the present maximum and is maintained with ±2° C. of said maximum to the end of the cooking period.

Upon completion of the cooking period the pulp mixture was brought to room temperature and spent liquor was separated from the pulp first by suction filtration and then by washing the pulp with water.

EXAMPLE 1

Seven samples of southern yellow pine chips were subjected to the pulping treatment described in the invention. The ethylenediamine component of the pulping liquor is varied while maintaining other factors constant. The condition employed and the results of the effect of variation of ethylenediamine on the rate of delignification of pine are shown in Table 1 and FIG. 1.

TABLE 1

EFFECT OF VARIATION OF EDA IN EDA/ETOH/$H_2O$—AQ PULPING SYSTEM

| LIQUOR/WOOD RATIO = 10/1 COOKING TEMP = 180° C. | | AQ % ON WOOD = 1.0 TIME @ TEMP = 100 MTS | | ETOH ML/G WOOD = 3.47 BOMB IN SHAKER OIL BATH | |
|---|---|---|---|---|---|
| COOK NUMBER | EDA ML/G WOOD | $H_2O$ ML/G WOOD | % RESIDUAL PULP YIELD | % LIGNIN FREE YIELD | KAPPA NUMBER |
| 10 | 0 | 6.53 | 85.87 | −0 | 116 |
| 11 | .68 | 5.85 | 84.59 | −0 | 95.5 |
| 12 | 2.03 | 4.5 | 78.29 | 67.78 | 87.2 |
| 13 | 3.38 | 3.15 | 75.72 | 66.89 | 75.7 |
| 6 | 4.05 | 2.48 | 72.72 | 65.66 | 63 |
| 14 | 4.74 | 1.79 | 75.2 | 66.85 | 72.1 |
| 15 | 6.53 | 0 | 76.35 | 67.05 | 79.1 |

% lignin free yield = % residual pulp yield (1 − K × 0.154/100)

EXAMPLE 2

Figure 2:
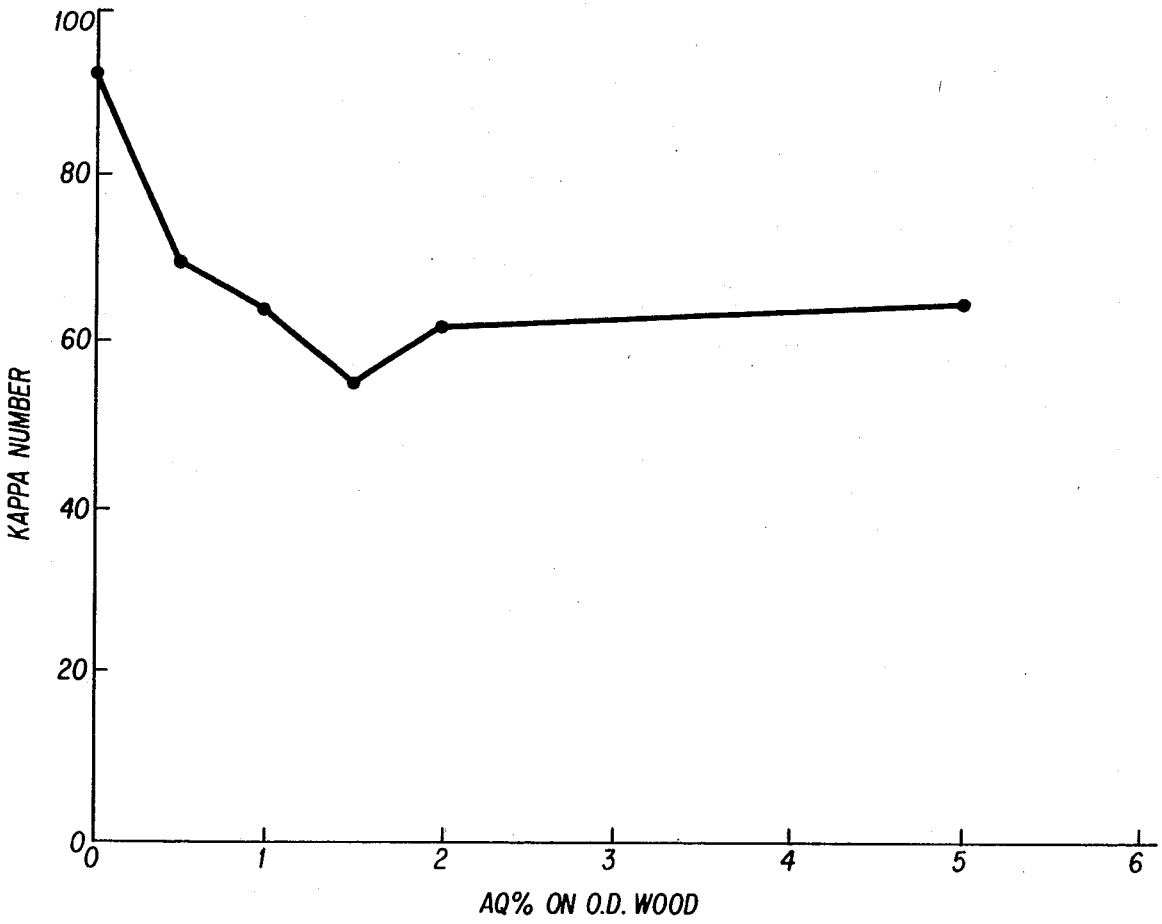
FIG. 2 is a graphic illustration of the effects of variation of catalyst amounts in this invention.

Six samples of southern yellow pine chips were subjected to the pulping treatment according to the present invention. In these experiments, the charge of anthraquinone is varied while keeping other factors constant. FIG. 2 shows the variation in lignin content of aqueous ethanol-ethylenediamine-anthraquinone pulp expressed in terms of kappa number along the vertical axis, and anthraquinone content of the treatment liquor expressed in terms of percent by weight anthraquinone of the oven dry weight of wood along the horizontal axis.

EXAMPLE 3

Figure 3:
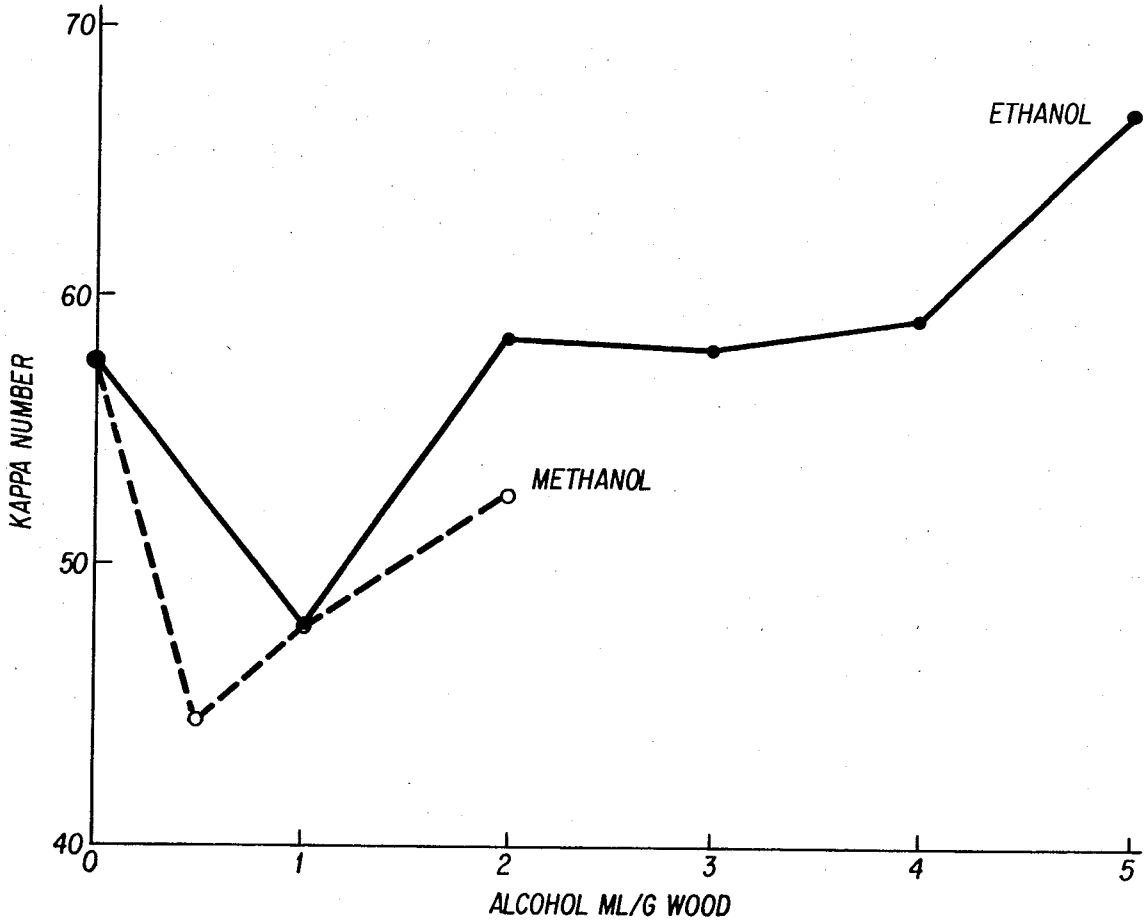
FIG. 3 is a graphic illustration of the effects of varying amounts of alcohol in this invention.

Six samples of southern yellow pine chips were subjected to the pulping treatment according to the invention. The ML ethanol charged per oven dry wood was varied while holding other variables constant. Cooking experiments were carried out using the same digester and procedures as in Example 1. Three samples were also treated with pulping liquor according to the invention but by substituting methanol for ethanol. The results are indicated in FIG. 3.

EXAMPLE 4

Ten samples of southern yellow pine chips were subjected to pulping experiments according to the present invention. Cooking was carried out using the digester and similar procedures as in Example 1. The effects of variation in cooking temperature and time and liquor:wood ratio on the delignification of southern yellow pine is shown in Table 2.

TABLE 2

EFFECT OF VARIATION OF LIQUOR:WOOD RATIO, COOKING TEMP. AND TIME IN AQUEOUS ETHYLENEDIAMINE-ETHANOL-ANTHRAQUINONE PULPING OF SOUTHERN YELLOW PINE
Liquor composition = Ethylenediamine/Ethanol/Water = 5/1/5
Shaker bomb reactor in oil bath; chips size = −10 + 30 U.S. mesh

| Cook Number | Liquor:Wood Ratio (MLig) | % AQ. on Wood | Cooking Temp. °C. | Cooking Time Minutes | Kappa Number | Total Pulp Yield % on Wood |
|---|---|---|---|---|---|---|
| 1 | 5:1 | 1.0 | 190 | 100 | 34.7 | 59.42 |
| 2 | 7:1 | 1.0 | 190 | 100 | 32.3 | 59.87 |
| 3 | 9:1 | 1.0 | 190 | 100 | 31.8 | 58.9 |

TABLE 2-continued

EFFECT OF VARIATION OF LIQUOR:WOOD RATIO, COOKING TEMP. AND TIME IN AQUEOUS ETHYLENEDIAMINE-ETHANOL-ANTHRAQUINONE PULPING OF SOUTHERN YELLOW PINE
Liquor composition = Ethylenediamine/Ethanol/Water = 5/1/5
Shaker bomb reactor in oil bath; chips size = −10 + 30 U.S. mesh

| Cook Number | Liquor:Wood Ratio (MLig) | % AQ. on Wood | Cooking Temp. °C. | Cooking Time Minutes | Kappa Number | Total Pulp Yield % on Wood |
|---|---|---|---|---|---|---|
| 4 | 11:1 | 1.0 | 190 | 100 | 33.6 | 58.94 |
| 5 | 11:1 | 1.5 | 180 | 100 | 47.8 | 64.46 |
| 6 | 11:1 | 1.5 | 190 | 100 | 31.3 | 58.93 |
| 7 | 11:1 | 1.5 | 200 | 100 | 24.0 | 57.64 |
| 8 | 11:1 | 1.5 | 190 | 60 | 43.4 | 65.00 |
| 9 | 11:1 | 1.5 | 190 | 120 | 30.3 | 59.65 |
| 10 | 11:1 | 1.5 | 190 | 140 | 39.6 | 61.13 |

Figure 4:
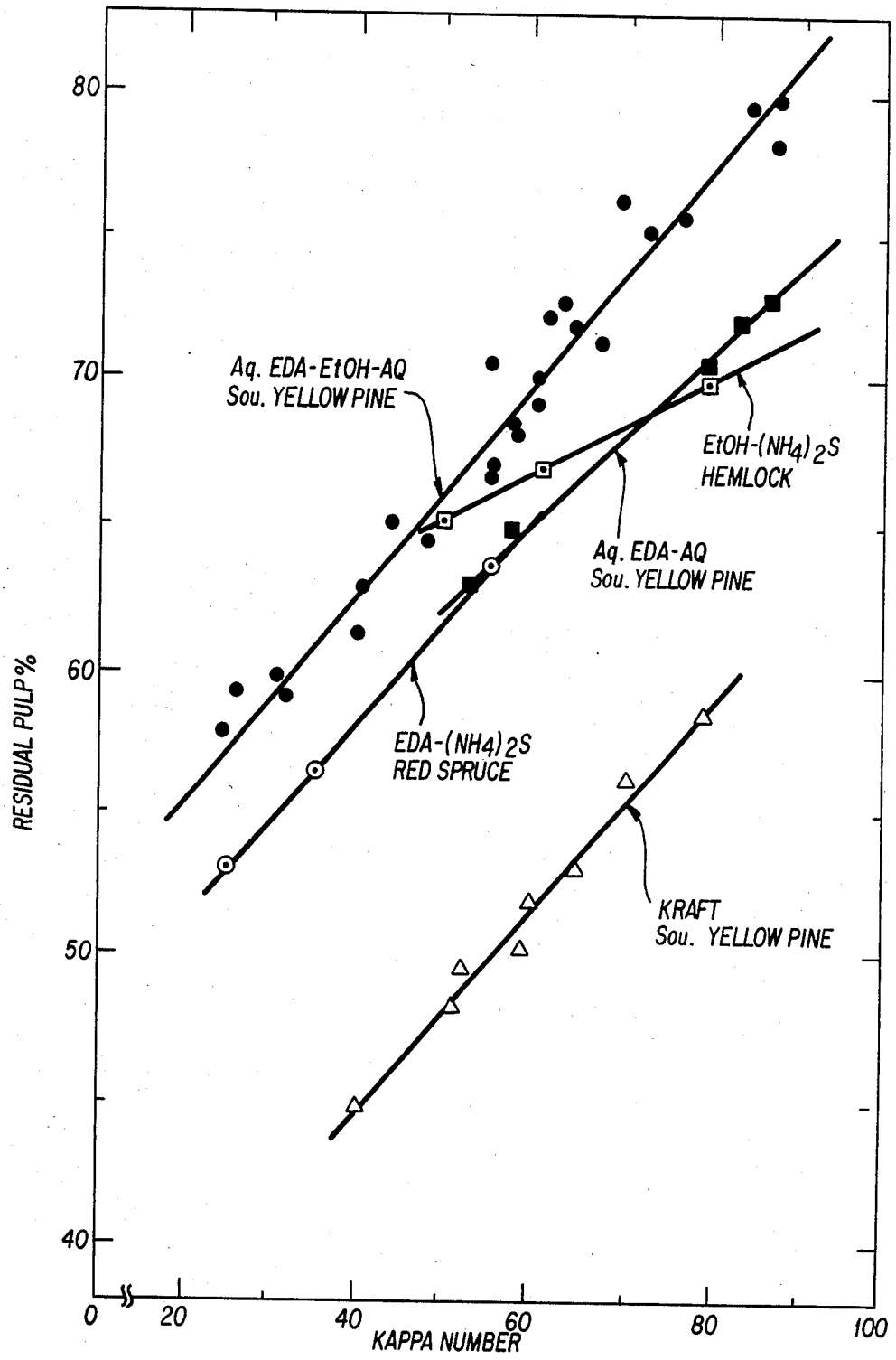
FIG. 4 is a graphic comparison of this invention with art-recognized processes.

FIG. 4 is a graph of residual pulp yield of southern yellow pine prepared in accordance with the present invention along the vertical axis; with the lignin content expressed in terms of kappa number along the horizontal axis. For comparison, selectivity plots of aqueous ethylenediamine anthraquinone (without ethanol) and Kraft pulping for the same lignocellulosic material, ethanol ammonium sulfide pulping of hemlock and ethylenediamine-ammonium sulfide pulping of red spruce are also shown. The invented process clearly demonstrates superior selectivity over all of the delignification processes currently known.

EXAMPLE 5

One sample of industrial size chips of southern yellow pine was also subjected to the pulping experiments in accordance with the present invention using an electrically heated Parr reactor equipped with stirrer, while a second sample is subjected to the conventional Kraft pulping. The pulping conditions and the results are indicated in Table 3. Pulps obtained from these experiments were subjected to carbohydrate analysis and the results are shown in Table 4.

EXAMPLE 6

Four samples of southern yellow pine chips were subjected to the pulping experiments according to the present invention. Cooking experiments were carried out in the similar digester as detailed in Example 1. The spent liquor from the pulping experiment were analyzed for the recoverable ethanol and ethylenediamine. Also the ethylenediamine lost to the pulp was estimated. The results are shown in Table 5.

TABLE 3

COMPARISON OF EDA—ETOH—$H_2O$—AQ PULPING WITH KRAFT PULPING METHOD USING 1.5 LITER BOMB DIGESTER
System: Batch Digestor

| COOK # | EEAQ | KRAFT |
|---|---|---|
| Active alkali as $Na_2O$ % on wood | — | 23 |
| Sulfidity | — | 31.55 |
| Liq/wd ratio (ml/g) | 7/1 | 5/1 |
| Ethanol ml/g wood | 0.64 | — |
| EDA ml/g wood | 3.18 | — |
| AQ % on wood | 0.75 | — |
| Cooking temp °C. | 190 | 170 |
| Cooking time (mts) | 115 | 140 |
| Total pulp yld % on wood | 57.75 | 45.80 |
| Lignin free pulp yld % on wood | 55.22 | 43.2 |

TABLE 3-continued

COMPARISON OF EDA—ETOH—$H_2O$—AQ PULPING WITH KRAFT PULPING METHOD USING 1.5 LITER BOMB DIGESTER
System: Batch Digestor

| COOK # | EEAQ | KRAFT |
|---|---|---|
| Kappa number | 28.5 | 36.5 |

TABLE 4

CARBOHYDRATE AND LIGNIN ANALYSIS OF SOUTHERN YELLOW PINE WOOD AND PULPS

| | Wood | Kraft | EEAQ |
|---|---|---|---|
| Kappa number | — | 36.5 | 31.10 |
| Residual pulp yield % (on wood) | — | 45.80 | 58.67 |
| Klason lignin | | | |
| % (on pulp) | — | 5.62 | 3.75 |
| % (on wood) | 28.30 | 2.57 | 2.20 |
| Araban | | | |
| % (on pulp) | — | 0.50 | 0.30 |
| % (on wood) | 1.16 | 0.23 | 0.18 |
| % lost* | — | 80.18 | 84.48 |
| Xylan | | | |
| % (on pulp) | — | 6.20 | 3.94 |
| % (on wood) | 5.71 | 2.84 | 2.31 |
| % lost | — | 50.37 | 59.54 |
| Mannan | | | |
| % (on pulp) | — | 9.44 | 18.75 |
| % (on wood) | 12.17 | 4.32 | 11.00 |
| % lost | — | 64.47 | 9.60 |
| Glucan | | | |
| % (on pulp) | — | 79.36 | 73.11 |
| % (on wood) | 45.05 | 36.34 | 42.90 |
| % lost | — | 19.30 | 4.80 |

*% Lost - based on original content in the wood.

TABLE 5

MATERIAL BALANCE IN EDA—ETHANOL—AQ PULPING
Liquor/Wood Ratio=11/1 EDA/Wood=5/1 Ethanol/Wood=1/1
AQ % on O D Wood=1.0 Shaker Oil Bath (Batch)

| Cook Number | EEB1 | EEB2 | EEB3 | EEB4 | Control W/O Chips |
|---|---|---|---|---|---|
| Cooking temp °C. | 190 | 190 | 190 | 200 | 190 |
| Cooking time (mins) | 60 | 80 | 100 | 100 | 100 |
| % EDA lost to pulp (on charged EDA) | 0.1 | 0.1 | 0.09 | 0.09 | — |
| % EDA in spent liquor (on charged EDA) | 99.91 | 99.06 | 98.93 | 99.06 | 99.23 |
| % EDA | 99.24 | 98.48 | 98.00 | 97.93 | 99.87 |

TABLE 5-continued

MATERIAL BALANCE IN EDA—ETHANOL—AQ PULPING

Liquor/Wood Ratio=11/1 EDA/Wood=5/1 Ethanol/Wood=1/1 AQ % on O D Wood=1.0 Shaker Oil Bath (Batch)

| Cook Number | EEB1 | EEB2 | EEB3 | EEB4 | Control W/O Chips |
|---|---|---|---|---|---|
| recovered after NaOH distillation | | | | | |
| % Ethanol recovered | 93.5 | 95.9 | 94.8 | 94.5 | — |
| Kappa number | 54.9 | 47.4 | 39.7 | 25.6 | — |
| Res. pulp yield % | 66.7 | 64.54 | 62.33 | 59.12 | — |

EDA content determined by Kjeldahl analysis.

EXAMPLE 7

Figure 5:
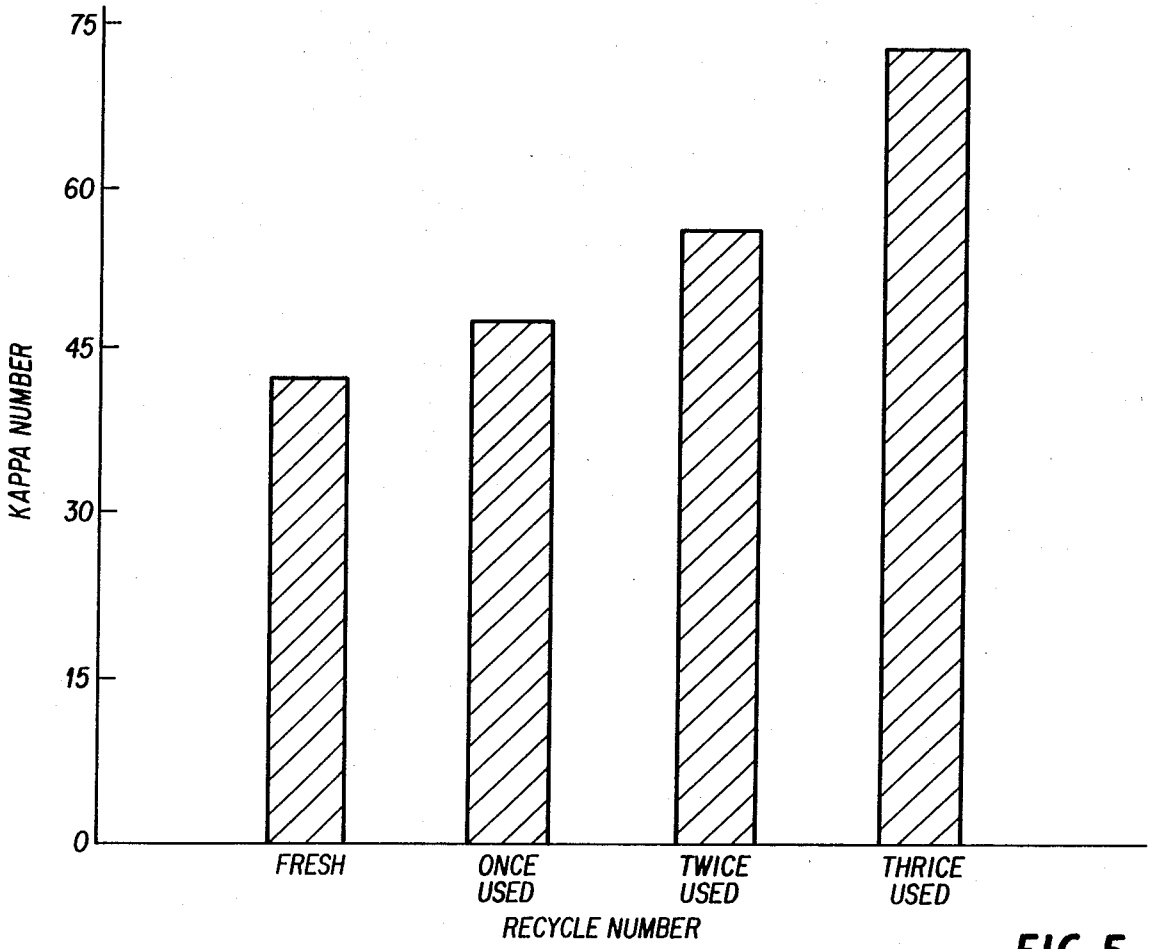
FIG. 5 is a graphic illustration of the effects of pulping liquor recycling in this invention.

Several samples of southern yellow pine chips were subjected to pulping experiments according to the present invention. Cooking was carried out in the shaker bomb reactor in oil bath as in Example 1. The spent liquor obtained from this set of experiments was adjusted for the original concentration of ethylenediamine, ethanol and anthraquinone. The spent liquor so adjusted for concentration was used as pulping liquor for further pulping experiments. The spent liquor was recycled several times. The results of the effect of recycling spent liquor on the extent of delignification of southern yellow pine in aqueous ethylenediamine-ethanol-anthraquinone are shown in FIG. 5.

EXAMPLE 8

Twelve samples of sweet gum chips were subjected to pulping experiments according to the present invention. Cooking was carried out in the digester as in Example 1. The effects of several variables of the pulping on the delignification of sweet gum is shown in Table 6. For comparison, typical results of Kraft pulping of sweet gum are also shown.

Although the above process and pulping liquor have been described with reference to particular and preferred embodiments, particularly with regard to the compositions employed and parameters observed, they are illustrative only. Variations will occur to those of ordinary skill in the art without the exercise of inventive faculty which remain within the scope of the invention as claimed below.

What is claimed as new and desired to be covered by Letters Patent of the United States is:

1. A pulping liquor for the delignification of lignocellulosic material consisting essentially of:

(A) a low molecular weight aliphatic alcohol selected from the group consisting of methanol, ethanol, butanol, pentanol and mixtures thereof;

(B) an aliphatic amine selected from the group consisting of ethylene diamine, propylene diamine, hexamethylene diamine, methylaniline, ethylamine and mixtures thereof; and (C) water, wherein each of (A), (B), and (C) are present in amounts of 1–12 parts by volume, said liquor further comprising a catalyst selected from the group consisting of anthraquinone, benzoquinone, napthaquinone, phenazine, derivatives thereof and mixtures thereof present in amounts of grams of catalyst per milliliter of pulping liquor in a range of about 0.1:4 to 0.001:15.

2. The pulping liquor of claim 1, wherein said pulping liquor is particularly suited for the delignification of hardwood materials, wherein said components (A), (B) and (C) are present in a volume ratio of 1:7.5:11.5, respectively.

3. The pulping liquor of claim 1, wherein said pulping liquor is particularly suited for the delignification of softwood materials and said components (A), (B) and (C) are present in a volume ratio of 1:5:5, respectively.

4. The pulping liquor of claim 1, wherein said ratio is from about 0.015:4 to 0.005:12.

5. A process for the delignification of cellulosic materials, comprising:

cooking said cellulosic material with a pulping liquor consisting essentially of a low molecular weight aliphatic alcohol selected from the group consisting of methanol, ethanol, butanol, pentanol and mixtures thereof, an aliphatic amine selected from the group consisting of ethylene diamine, propylene diamine, hexamethylene diamine, methylaniline, ethylamine and mixtures thereof and water, wherein said alcohol, amine and water are each present in amounts of 1–12 parts by volume, said cooking further being conducted in the presence of a catalyst selected from the group consisting of anthraquinone, benzoquinone, napthaquinone, phenazine, derivatives thereof and mixtures thereof, said catalyst being present in amounts of grams of catalyst per milliliter of pulping liquor in a ratio of about 0.1:4 to 0.001:15, at a temperature of about 140°–200° C. for a period of about 50–360

TABLE 6

PULPING OF SWEET GUM (HARDWOOD) IN ACCORDANCE WITH THE INVENTED PROCESS

Chips Size - (−10 + 30); Wood Used Per Digester = 2.0 g (oven dry)

Shaker Bomb Reactor in Oil Bath; Liq:Wood Ratio ML/g = 10:1

| Cook Number | Cooking Temp. °C. | Cooking Time Minutes | ML EDA | ML Ethanol | Mg. Anthraquinone | Kappa Number | Total Pulp Yld. |
|---|---|---|---|---|---|---|---|
| 1 | 160 | 80 | 7.5 | 0.0 | 20 | 35.2 | 60.7 |
| 2 | 160 | 80 | 7.5 | 1.0 | 20 | 37.3 | 63.6 |
| 3 | 160 | 80 | 7.5 | 2.5 | 20 | 45.0 | 66.2 |
| 4 | 160 | 80 | 7.5 | 1.0 | 0 | 79.8 | 68.6 |
| 5 | 160 | 80 | 7.5 | 1.0 | 4 | 65.0 | 65.4 |
| 6 | 160 | 80 | 7.5 | 1.0 | 10 | 56.6 | 64.3 |
| 7 | 170 | 80 | 7.5 | 1.0 | 10 | 54.3 | 63.6 |
| 8 | 172 | 80 | 7.5 | 1.0 | 10 | 42.3 | 60.9 |
| 9 | 175 | 80 | 7.5 | 1.0 | 10 | 23.7 | 57.3 |
| 10 | 172 | 60 | 7.5 | 1.0 | 10 | 43.7 | 61.0 |
| 11 | 172 | 95 | 7.5 | 1.0 | 10 | 19.2 | 59.9 |
| 12 | Kraft pulping with 23% active alkali at 170° C. for 90 mts; | | | | | 32.8 | 52.0 |

minutes, wherein the ratio of grams of cellulosic material to milliliters of pulping liquor is about 1:4 to 1:15.

6. The process of claim 5, wherein said cellulosic material is comprised of softwood, said alcohol, amine and water are present in a ratio 1:5:5, respectively, and said temperature and time range between 170°–190° C. and 60–120 minutes, respectively.

7. The process of claim 5, wherein said material is comprised of hardwood, said alcohol, amine and water are present in amounts of 1:7.5:11.5 parts by volume, respectively, and said cooking temperature and time is between 160°–175° C. and 60–120 minutes, respectively.

8. The process of claim 5, wherein said ratio of grams of cellulosic material to milliliters of pulping liquor is about 1:4 to 1:12.

9. The process of claim 5, wherein said process further comprises recycling said liquor after said cooking for the delignification of additional cellulosic material.

10. The process of claim 9, wherein the alcohol and amine content of said liquor is recovered after repeated recycling by distillation.

11. The process of claim 5, wherein the alcohol and amine content of said liquor after cooking is recovered by distillation.

* * * * *